United States Patent [19]

Ignatuk et al.

[11] Patent Number: 4,501,091

[45] Date of Patent: Feb. 26, 1985

[54] APPARATUS FOR PREPARING AN OPTICAL WORKPIECE

[75] Inventors: Wayne R. Ignatuk, Morris Plains; Frank M. Plocic, Bridgewater, both of N.J.

[73] Assignee: Litton Systems, Inc., Morris Plains, N.J.

[21] Appl. No.: 422,818

[22] Filed: Sep. 24, 1982

[51] Int. Cl.[3] ..... B24B 9/14

[52] U.S. Cl. ..... 51/102; 51/103 TF; 51/130; 51/284 E; 51/289 R

[58] Field of Search ..... 51/102, 103 TF, 107, 51/130, 103 WH, 284 E, 289 R

[56] References Cited

U.S. PATENT DOCUMENTS

| | | | |
|---|---|---|---|
| 422,966 | 3/1890 | Ormsby | 51/130 |
| 463,418 | 11/1891 | Dyke | 51/130 |
| 965,776 | 7/1910 | Weeks | 51/130 |
| 1,055,808 | 3/1913 | Schmidt | 51/130 |
| 1,729,780 | 10/1929 | Holmes | 51/103 WH |
| 1,783,034 | 11/1930 | Booth | 51/103 TF |
| 1,886,579 | 11/1932 | Pew | 51/130 |
| 2,091,655 | 8/1937 | Scrivener | 51/103 WH |
| 2,915,854 | 12/1959 | Ettman | 51/102 |

*Primary Examiner*—Harold D. Whitehead

*Attorney, Agent, or Firm*—Michael H. Wallach; Robert F. Rotella

[57] ABSTRACT

A drum is mounted to rotate about its drum axis. A pair of elongated, complementary guides are proximate to and extend along the axial length of the drum. The guides are sized and spaced to allow a workpiece to span the guides and roll upon them. A driver is mounted alongside the guides for rolling the workpiece on them. These guides are positioned between the drive means and the drum. The workpiece is positionable between the driver and the guides to protrude beyond the guides and reach the drum.

12 Claims, 8 Drawing Figures

FIG. 2
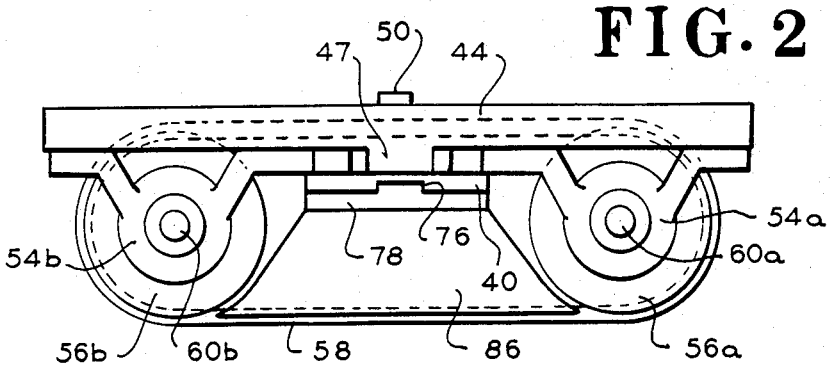
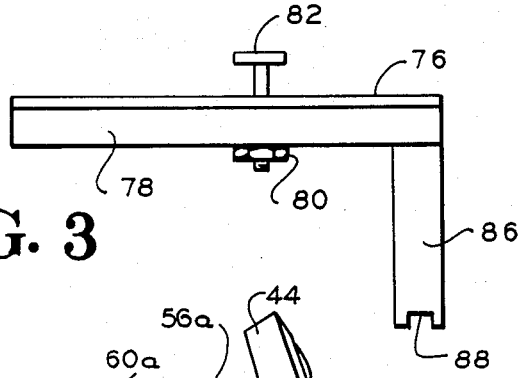
FIG. 3
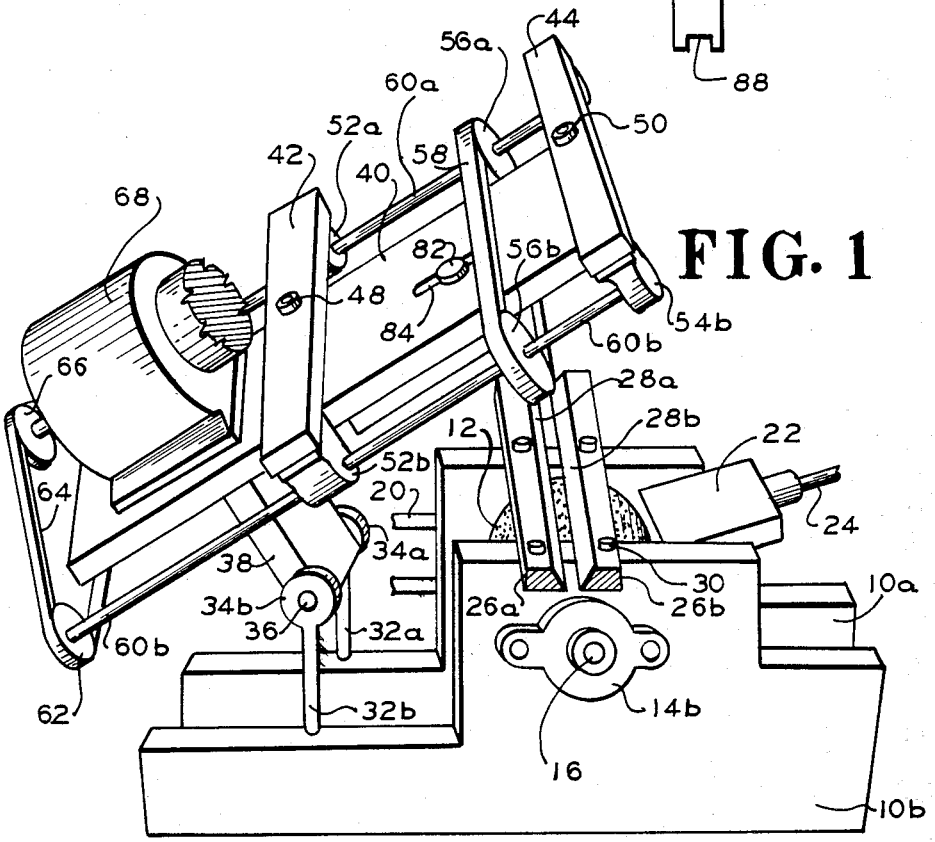
FIG. 1

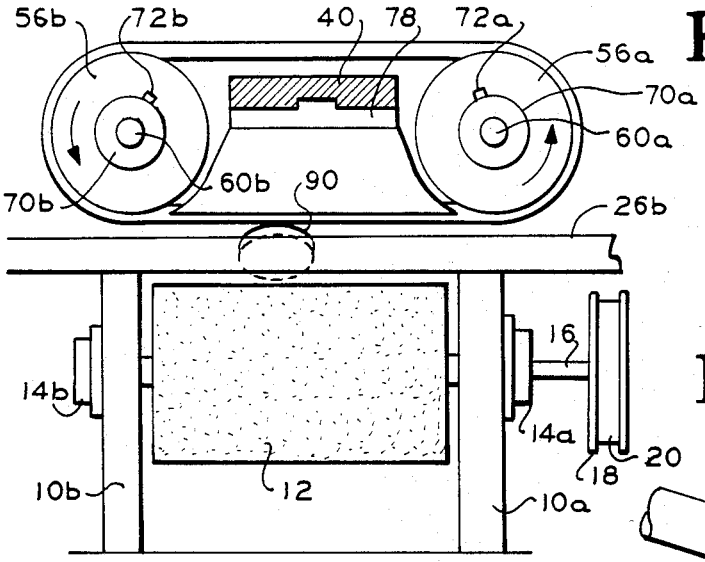
FIG. 4
FIG. 5
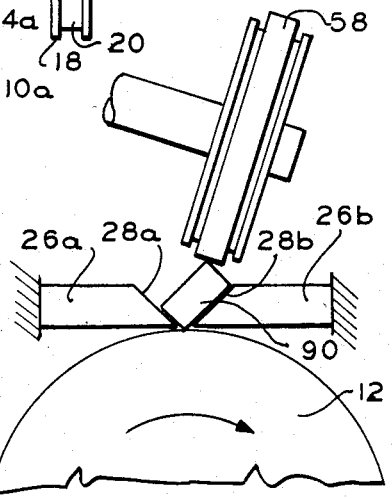
FIG. 6
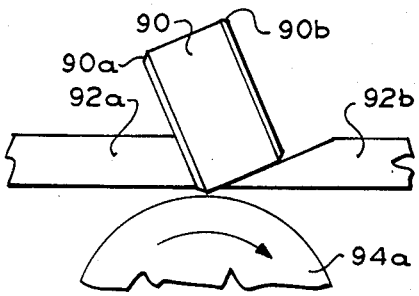
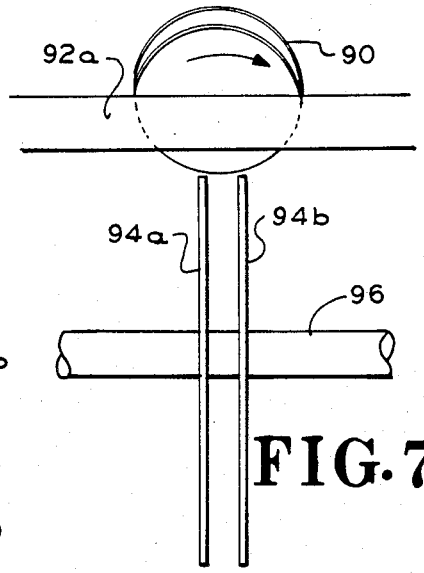
FIG. 7
FIG. 8
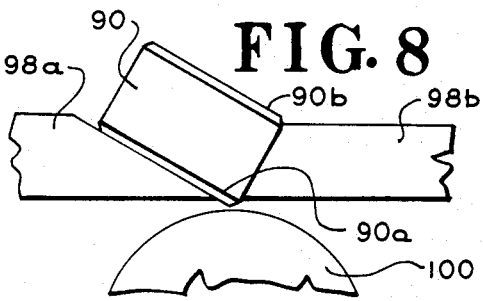

APPARATUS FOR PREPARING AN OPTICAL WORKPIECE

BACKGROUND OF THE INVENTION

The present invention relates to apparatus for preparing an optical workpiece and, in particular, to equipment for finishing, beveling and/or marking such workpieces.

Known lenses and mirrors having a generally cylindrical shape are often finished by rubbing their flat surfaces to form either a plane or curved surface. A problem is that the sharp edges of the cylinder can be easily chipped during the finishing operation. Accordingly, it is known to bevel such edges to avoid the possibility of chipping.

One technique for beveling an optical device involves pressing the edges of a cylindrical blank against a rotating cup that has been prepared with an abrasive. However the operator often does not hold the blank squarely against the cup or may move the blank during the beveling operation thereby rendering the bevel nonuniform.

Another problem with preparing optical devices is distinguishing one side of a cylindrical blank from the other. The flat sides may require different finishes in that one may be slightly convex or concave but to an extent not readily visible. Alternatively one side may be coated. It is known to grind an identifying mark into one of the edges of the optical device before finishing to distinguish its flat sides. In the past this has been done by manually holding the edge against a cutting wheel.

A disadvantage with all of the foregoing operations is that they are performed manually and are therefore time consuming and subject to inconsistencies.

Accordingly, there is a need for equipment to quickly, reliably and preferably automatically prepare an optical workpiece.

SUMMARY OF THE INVENTION

In accordance with the illustrative embodiments demonstrating features and advantages of the present invention, there is provided apparatus for preparing an optical workpiece. The apparatus includes a drive means, a power means and a pair of elongated, complementary guides. The guides are proximate to and extend alongside the power means. The guides are sized and spaced to allow the workpiece to span the guides and roll upon them. The drive means is mounted alongside the guides for rolling the workpiece on the guides. These guides are positioned between the drive means and the power means. The workpiece is positionable between the drive means and guides to protrude beyond the guides and reach the power means.

In a related method of the same invention an optical workpiece is prepared with a guide adjacent to a rotating drum. The method includes the step of positioning the guide along the length of the drum. Another step is rolling the workpiece on the guide, allowing the workpiece to touch the drum.

By employing apparatus and methods of the foregoing type an improved, efficient and reliable technique is provided for preparing the edge of an optical workpiece. In a preferred embodiment, the workpiece is a cylindrical optical device which is rolled along a pair of guides having the shape of beveled bars. Preferably, these beveled surfaces are perpendicular to each other so that a cylindrical optical workpiece can be supported without rocking or shifting. The optical workpieces are allowed to roll along the guides and to protrude between them to touch an abrasive drum. This drum may have a diamond abrasive coating for beveling the edge of the optical workpiece. In this preferred embodiment, the drive for rolling the workpiece is an endless belt that circulates on a pair of wheels rotatably mounted on a hinged beam. Being hinged, the beam can allow the drive belt to descend onto the optical workpiece by the force of gravity. The lower stretch of the drive belt touching the optical workpiece is backed by a channel-like device that provides firmness for driving the workpiece. In a preferred embodiment, the motor for driving the drive belt is mounted on the beam carrying the drive belt and wheels to allow simple mechanical coupling. Such mounting can be advantageous in that the weight of the motor is used to urge the drive belt against the workpiece.

Also in one preferred embodiment the optical workpiece can progress from one station to another wherein first one and then the other circular edge is beveled. Furthermore other stations can tilt the optical workpiece so the border of the bevel along the flat surface of the workpiece can be polished at another station. At still another station the other border of the beveled edge contiguous to the curved surface of the workpiece can be notched by a circular saw. All of these stations can be interconnected so that the optics move in procession from one station to the next, automatically grinding, marking and polishing the bevel.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings wherein:

FIG. 1 is a perspective view of apparatus according to the principles of the present invention;

FIG. 2 is an end view of the drive means of the apparatus of FIG. 1;

FIG. 3 is a side view of the guide of the drive means of FIG. 2;

FIG. 4 is an elevational end view, partly in section, of the apparatus of FIG. 1;

FIG. 5 is a schematic side view of the work area of the apparatus of FIG. 1;

FIG. 6 is a detailed schematic side view showing an arrangement which is an alternate to that of FIG. 5;

FIG. 7 is a front view of the apparatus of FIG. 6; and

FIG. 8 is a detailed side view of an arrangement which is an alternate to that of FIG. 6.

DETAILED DESCRIPTION OF THE PREFERRED EMBODIMENTS

Referring to FIGS. 1–4, the illustrated apparatus for preparing a workpiece includes a pair of bases 10*a* and 10*b* which are parallel plates having raised, rectangular portions spanned by a drum 12. Drum 12 is a cylinder having a deposit of diamond abrasives on it, in this embodiment. Drum axis 16 of drum 12 is journalled in end bearings 14*a* and 14*b* mounted on the outside surfaces of plates 10*a* and 10*b*, respectively. Drum axle 16 extends beyond bearing 14*a* to a drive pulley 18 which is encircled by drive belt 20. Drive belt 20 is circulated by a drum motor (not shown). Mounted alongside drum 12 to spray a lubricating medium such as a light oil onto drum 12 is wedge shaped nozzle 22 which is fed by inlet pipe 24. Spray nozzle 22 and plates 10*a* and 10*b* may be mounted in a basin which acts as a reservoir for the lubricating fluid for nozzle 22, (basin not shown).

A pair of guides 26*a* and 26*b* are shown herein as a pair of parallel rods having a substantially trapezoidal cross-section. Guides 26*a* and 26*b* can be formed from rectangular rods which have had a corner cut into planar, beveled, support surfaces 28*a* and 28*b*. Guides 26*a* and 26*b* are mounted atop the central raised portion of bases 10*a* and 10*b* perpendicular thereto. The guides are secured to the upper edges of plates 10*a* and 10*b* by appropriate bolts 30 which fit through elongated holes in guides 26*a* and 26*b* to allow adjustment transverse to the axis of drum 12.

Mounted atop the rear edges of bases 10*a* and 10*b* are upright standards 32*a* and 32*b*, respectively. The upper ends of standards 32*a* and 32*b* terminate in eyes 34*a* and 34*b*, respectively, into which are journalled a support axis 36. Support axis 36 is an axle mounted through a complementary bore in the lower end of rectangular plate 38. Plate 38 is perpendicularly mounted to the underside of beam 40, another rectangular plate. Beam 40 has mounted atop it a pair of spaced, parallel cross-beams 42 and 44, each connected to beam 40 by central, rectangular stubs 47 and 46 by means of bolts 48 and 50. Mounted on each underside of cross-beams 42 and 44 are a pair of dependent bearings all aligned parallel to beam 40: Cross-beam 42 supports on one of its ends right bearing 52*a* and left bearing 52*b* on its other end. Cross-beam 44 similarly supports right bearing 54*a* and left bearing 54*b*. Bearings 54*a* and 54*b* are aligned with bearings 52*a* and 52*b*, respectively.

A drive means is shown herein as a pair of drive wheels 56*a* and 56*b*, encircled by an endless belt 58. Belt 58 comprises an outer portion above wheels 56*a* and 56*b* as well as an inner portion below the wheels. This inner portion is preferably at least as long as drum 12. Wheels 56*a* and 56*b* and their respective hubs 70*a* and 70*b* (FIG. 4) are affixed to axles 60*a* and 60*b*, respectively, by means of set screws 72*a* and 72*b*. Axle 60*a* is journalled in bearings 52*a* and 54*a*, axle 60*b* being journalled in bearings 52*b* and 54*b*. Axles 60*a* and 60*b* extend backwardly beyond their respective bearings 52*a* and 52*b* and terminate in a drive pulley, only drive pulley 62 of axle 60*b* being visible herein. These pulleys are encircled by a belt 64 which also encircles drive pulley 66 driven by DC motor 68. Motor 68 is thus connected as the means for driving belt 58. Motor 68 can be controlled by an appropriate controller (not shown) to regulate its DC voltage and thus control its angular speed. The underside of beam 40 has a rectangular channel which receives complementary ridge 76 rising from the upper side of rectangular carrying plate 78. Rectangular plate 78 is mounted flush against the underside of beam 40 by means of bolt 82 and can be longitudinally slid by loosening nut 80 (FIG. 3) which normally holds bolt 82 in place. Sliding is facilitated by elongated slot 84 piercing beam 40. Depending perpendicularly from the forward end of plate 78 is plate 86. Plate 86 has two horizontal parallel edges, a flat upper edge and a lower edge cut by rectangular channel 88. The two other lateral edges of plate 86 are shaped approximately as a quadrant of a circle to match the circumference of adjacent drive wheels 56*a* and 56*b*. Plate 86 is positioned and dimensioned so that it holds and backs the inner portion of belt 58 as it travels below drive wheels 56*a* and 56*b*. Preferably the bottom of channel 88 is coated with a suitable lubricant or is lined with a Teflon coating. It will be appreciated that drive belt 58 can be shifted by axially readjusting the position of drive wheels 56*a* and 56*b* and simultaneously repositioning plate 78 and its channel 88 by loosening and retightening nut 80 to allow bolt 82 to slide through slot 84.

The operation of the foregoing apparatus will now be briefly described. The equipment is started by energizing motor 68 and by driving belt 20 to rotate drum 12. Motor 68 has its speed set such that belt 58 can complete its circuit in about one to three seconds. Of course, different speeds can be chosen depending upon the desired feed rates for the workpieces, the fragility of workpieces being handled, etc. A cylindrical optical workpiece 90 can be set down in guides 26*a* and 26*b* to span them as illustrated in FIG. 5. The curved surface of workpiece 90 rolls on surface 28*a*, its flat surface sliding across surface 28*b*. In the embodiment shown, surfaces 28*a* and 28*b* are perpendicular to each other and each bear an angle of 45° with respect to vertical. It is expected that a sequence of workpieces will be set in a row in guides 26*a* and 26*b* to roll in procession. The first workpiece reaching drive belt 58 is engaged by that belt at the upper circular edge of the workpiece. Since belt 58 is linearly progressing, it rolls workpiece 90 so that the lower edge is rolled onto drum 12 thereby producing a beveled edge. It will be appreciated that since the spacing between the center of workpiece 90 and the upper surface of drum 12 remains fixed, workpiece 90 cannot be overground. The length of the guides 26*a* and 26*b* are chosen such that workpiece 90 turns more than once and preferably one and two-thirds times, over the length of drum 12. This length is chosen to accomodate the largest expected workpiece. Thus, drum 12 acts as a power shaper (or power means).

After one of the edges of workpiece 90 is beveled in this fashion, it can roll along guides 26*a* and 26*b* to a transfer guide (not shown) which can be in the form of a rectangular conduit having a 90° twist. This twist effectively shifts by 90° the rolling axis of workpiece 90 so the unbeveled edge of workpiece 90 now points downwardly. Thereafter, workpiece 90 can be brought to another station, similar to the one illustrated in FIG. 1, where the other edges of workpiece 90 can be beveled.

The resulting workpiece has beveled edges 90*a* and 90*b* as illustrated in FIG. 6. These beveled edges have a surface intersecting the flat and cylindrical surfaces of workpiece 90 at 135°. In FIGS. 6 and 7 another operation is illustrated wherein workpiece 90 is rolled to still another station along new guides 92*a* and 92*b*, whose supporting surfaces bear an angle at 67.5° and 22.5°, respectively, with respect to horizontal. At these angles bevel 90*a* is oriented so that its border with the cylindrical side of workpiece 90 points downwardly through guides 92*a* and 92*b*. Workpiece 90 rolls along guides 92*a* and 92*b* in an apparatus similar to that described in FIG. 1. However, the previously illustrated drum 12 is replaced herein by a pair of circular saws 94*a* and 94*b*. Circular saws 94*a* and 94*b* are coaxially mounted on drive shaft 96 which drives the saws and allows them to cut a pair of angularly spaced notches at the edges comprising the border between bevel 90*a* and the cylindrical side of workpiece 90. These notches can be used to identify one side of workpiece 90 from the other. Such differentiation is useful where the sides are prepared differently by having different coatings or different surfaces ground thereon.

Next (FIG. 8) workpiece 90 can be rolled onto new guides 98*a* and 98*b* to increase the elevation of the rolling axis of workpiece 90. Guides 98*a* and 98*b* have reversed angles with respect to horizontal, that is, angles of 22.5° and 67.5°, respectively. This orientation shifts workpiece 90 so that the edge representing the border between bevel 90*a* and the flat surface of workpiece 90 points downwardly between guides 98*a* and 98*b*. Workpiece 90 rolls on guides 98*a* and 98*b* through an apparatus similar to that described in FIG. 1 except that previously described drum is replaced with polishing wheel 100. Accordingly, the border between the flat side of workpiece 90 and bevel 90*a* is polished so that there is a degree of rounding at the border. This avoids chipping at this border.

Workpiece 90 may now be rolled along guides to another work station similar to that of FIG. 1. In making this transition, workpiece 90 is shifted from the position shown in FIG. 8 (that is, with its rolling axis at 67.5° to horizontal) by rotating the rolling axis by 180° so that the other edge of the workpiece 90 points downwardly. In particular, the edge representing the border between bevel 90*b* and the flat surface of workpiece 90 projects downwardly through guides 98*a* and 98*b* (FIG. 8) so that border may be polished annd rounded. Alternatively the rolling axis of workpiece 90 may be rotated 135° (clockwise in FIG. 8) so that the above mentioned border is polished.

It is to be appreciated that various modifications may be implemented with respect to the above preferred embodiment. For example, various alternate driving means can be employed. For example, each of the workpieces can be straddled by a pair of idler wheels which are moved longitudinally along the guides to drive the workpieces. Furthermore, the illustrated guides can take various shapes and in some embodiments may be a rectangular conduit having a slot cut into its lower corner. Furthermore, in some embodiments the drum may be replaced with an endless belt having abrasives deposited thereon. Furthermore, while the illustrated drive belt is shown bearing against the workpiece by gravity, in other embodiments various springs and other biasing means can be used to apply pressure onto the workpieces. Furthermore, the various dimensions including the length and diameter of the grinding drum can be altered depending upon the size of the workpiece and other factors. It will also be understood that while a three-step process is illustrated (beveling, notching and polishing) in other embodiments, certain of these steps can be deleted, supplemented or substituted, depending upon the application. It is also expected that for some embodiments the grinding drum and the workpiece driving belt can have a common drive and the two systems can be mechanically linked together. Also, instead of a pair of circular saws one or more than two notching devices can be employed. In addition, the various dimensions and materials can be altered depending upon the size of the workpiece, the desired speed of operation, the required accuracy, tolerances etc.

Obviously, many modifications and variations of the present invention are possible in light of the above teachings. It is therefore to be understood that within the scope of the appended claims, the invention may be practiced otherwise than as specifically described.

What is claimed is:

1. Apparatus for preparing an optical workpiece comprising:

an abrasive cylindrical drum for shaping a portion of said workpiece;

a pair of adjustably-mounted, elongated complementary guides mounted proximate to and extending alongside said abrasive cylindrical drum, said guides being sized and adjustably spaced to allow said workpiece to span said guides and roll upon them; and drive means mounted alongside said guides for rolling said workpiece on said guides, said drive means being comprised of an endless belt mounted to circulate along a path with a portion of said path being parallel to said guides, said guides being positioned between said drive means and said abrasive cylindrical drum, said workpiece being positionable between said drive means and guides to protrude beyond said guides and reach said abrasive cylindrical drum.

2. Apparatus according to claim 1 wherein each of said guides has a support surface, the support surface of one of said guides being transverse to that of the other one of the guides.

3. Apparatus according to claim 1 wherein said drive means is above said abrasive cylindrical drum.

4. Apparatus according to claim 3 wherein said workpiece is cylindrical and has a pair of circular edges, said workpiece being positionable in said guides to allow one of said edges to protrude against said cylindrical abrasive drum for beveling.

5. Apparatus according to claim 4 wherein said drive means is pivotally mounted about a support axis parallel to said drum, gravity tending to hold said drive means against said workpiece.

6. Apparatus according to claim 5 wherein said drive means comprises:

a base;

a beam pivotally mounted on said base to extend over said guides;

a pair of spaced drive wheels rotatably mounted on said beam over said guides;

a belt looped around said drive wheels; and means for driving said belt around said wheels.

7. Apparatus according to claim 4 wherein said drum has a length exceeding the circumference of said workpiece.

8. Apparatus according to claim 6 wherein said drive means further comprises:

a channel mounted on said beam parallel to said guides, said belt spanning said wheels along an outer and an inner portion of said path, said inner portion being nearer to said guides, said channel embracing said inner portion of said belt.

9. A method according to claim 1 wherein said workpiece is cylindrical and has two circular edges, further comprising the steps of:

positioning said workpiece on said guides to extend a given one of said edges of said workpiece toward said cylindrical drum; and repositioning said workpiece to extend the other one of said edges in place of said given one.

10. A method of preparing an optical workpiece in an apparatus including an abrasive cylindrical drum for shaping a portion of said workpiece, a pair of adjustably-mounted elongated complementary guides mounted proximate to and extending alongside said cylindrical drum, said guides being sized and adjustably spaced to allow said workpiece to span said guides and roll upon them, and drive means mounted alongside said guides for rolling said workpiece on said guides, said drive means being comprised of an endless belt mounted to circulate along a path with a portion of said path being parallel to said guides, said guides being positioned between said drive means and said cylindrical drum, said method comprising the steps of:

(a) positioning said workpiece between said drive means and said guides to protrude beyond said guides and reach said cylindrical drum; and (b) rolling said workpiece on said guides while allowing said workpiece to touch said cylindrical drum.

11. Apparatus for preparing an optical workpiece comprising:

a circular saw for notching said workpiece;

a pair of adjustably-mounted, elongated complementary guides mounted proximate to and extending alongside said circular saw, said guides being sized and adjustably spaced to allow said workpiece to span said guides and roll upon them; and drive means mounted alongside said guides for rolling said workpiece on said guides, said drive means being comprised of an endless belt mounted to circulate along a path with a portion of said path being parallel to said guides, said guides being positioned between said drive means and said circular saw, said workpiece being positionable between said drive means and guides to protrude beyond said guides and reach said circular saw.

12. Apparatus for preparing an optical workpiece comprising:

a polishing wheel for polishing a portion of said workpiece;

a pair of adjustably-mounted, elongated complementary guides mounted proximate to and extending alongside said polishing wheel, said guides being sized and adjustably spaced to allow said workpiece to span said guides and roll upon them; and drive means mounted alongside said guides for rolling said workpiece on said guides, said drive means being comprised of an endless belt mounted to circulate along a path with a portion of said path being parallel to said guides, said guides being positioned between said drive means and said polishing wheel, said workpiece being positionable between said drive means and guides to protrude beyond said guides and reach said polishing wheel.

* * * * *

UNITED STATES PATENT AND TRADEMARK OFFICE

CERTIFICATE OF CORRECTION

PATENT NO. : 4,501,091

DATED : February 26, 1985

INVENTOR(S) : Wayne R. Ignatuk and Frank M. Plocic

It is certified that error appears in the above-identified patent and that said Letters Patent is hereby corrected as shown below:

Col. 6, line 55 - change Claim "9" to -- 10 --.

Col. 6, line 63 - change Claim "10" to -- 9 --.

Change dependency of newly-numbered claim 10 from "1" to --9--.

Signed and Sealed this

*Third* Day of *September 1985*

[SEAL]

*Attest:*

DONALD J. QUIGG

*Attesting Officer* *Acting Commissioner of Patents and Trademarks - Designate*